United States Patent [19]

Rikhy et al.

[11] Patent Number: 4,722,667

[45] Date of Patent: Feb. 2, 1988

[54] ROPE AND FISH NET GUARD

[75] Inventors: Arvind Rikhy, Cranbury, N.J.; Stamatis Makirnos, Brooklyn, N.Y.

[73] Assignee: Sea-Land Corporation, Elizabeth, N.J.

[21] Appl. No.: 852,442

[22] Filed: Apr. 15, 1986

[51] Int. Cl.[4] ..... B63H 1/28

[52] U.S. Cl. ..... 416/146 R; 416/247 A; 440/73

[58] Field of Search ..... 416/146 R, 146 B, 247 A; 440/71–73

[56] References Cited

U.S. PATENT DOCUMENTS

| | | | |
|---|---|---|---|
| 67,982 | 8/1867 | Hudson . | |
| 1,649,657 | 11/1927 | Blake | 440/73 |
| 1,813,540 | 7/1931 | Laska | 416/146 B |
| 2,143,693 | 1/1939 | Harris | 416/146 B |
| 4,070,984 | 1/1978 | Kappas . | |
| 4,211,515 | 7/1980 | Henrich et al. | 416/146 B |
| 4,304,559 | 12/1981 | Steward | 440/73 |
| 4,447,215 | 5/1984 | govan | 416/146 R X |
| 4,450,670 | 5/1984 | Robinson | 440/73 X |
| 4,507,091 | 3/1985 | Govan | 416/146 R X |
| 4,544,363 | 10/1985 | Govan | 416/146 R X |
| 4,578,040 | 3/1986 | Sumino et al. | 416/146 B |

FOREIGN PATENT DOCUMENTS

| | | | |
|---|---|---|---|
| 15013 | of 1892 | United Kingdom | 416/146 B |
| 587407 | 4/1947 | United Kingdom | 440/73 |
| 2028243 | 3/1980 | United Kingdom | 416/146 B |
| 256544 | 4/1970 | U.S.S.R. | 416/146 B |
| 755684 | 8/1980 | U.S.S.R. | 416/146 A |

*Primary Examiner*—Everette A. Powell, Jr.

*Attorney, Agent, or Firm*—Scully, Scott, Murphy & Presser

[57] ABSTRACT

The specification discloses a combined rope and fish net guard for use on large ocean going marine vessels. A rope guard extends outwardly from the stern frame to closely overlap the propeller hub. The propeller hub defines an annular groove underlying the rope guard. A cutting ring is mounted on the inner cylindrical wall of the rope guard and extends inwardly into the annular groove. The cutting ring is equipped with bidirectional cutting edges or teeth.

10 Claims, 4 Drawing Figures

ROPE AND FISH NET GUARD

FIELD OF THE INVENTION

The present invention relates to a Rope and Fish Net Guard for large ocean going marine vessels. More specifically, a cutting means is provided to sever mono-filament fish nets before they can damage the shaft seal for the propeller shaft of the vessel.

BACKGROUND OF THE INVENTION

The present invention is a combined rope and fish net guard and it is particularly adapted for use in large ocean going marine vessels. These vessels are commonly equipped with a rope guard that extends outwardly from the stern frame of the vessel to the propeller hub, thereby protecting the propeller shaft from stray lines, seaweed, nets, and other debris that may be encountered in the shipping lanes through which these vessels pass.

The advent of the mono-filament fish nets, however, has created a new hazard for large ocean going vessels. These mono-filament fish nets, some of which are hundreds of yards in length, may be found drifting in the ocean passages and in certain parts of the world, are staked out with little regard for commercial shipping lanes or the channel markers which guide these vessels. While the horsepower of the vessel's engines, and the size of the propellers render the fish nets a minimal threat to fouling the vessel's propellers, the extreme fineness of the mono-filament net renders it capable of posing still an additional threat to the vessel shaft seals. As the net becomes fouled in the propeller, it is stretched out and drawn across the conventional rope guard, and may be drawn through the gap between the stationary rope guard, and the rotating propeller, even though the gap is as small as a few millimeters in width. Once through the rope guard, the net will become wrapped around the vessel propeller shaft, and will work its way into the stern shaft seal of the vessel. In this position, it may abrade the shaft seal, or cause the shaft seal to leak, thereby presenting a potential and substantial threat to the vessel.

Depending on the direction of the vessel's motion, the RPM of the shaft, and the oil pressure maintained in the shaft seal, the netting may enable sea water to contaminate the oil used to lubricate the main stern bearings, or if the pressure in the oil system is higher than the sea water pressure, the nettings may allow the oil to escape into the shipping lane, or the harbor in which the vessel is maneuvering.

If the oil leaks out, it may contaminate the surrounding environment, and result in a large fine for the vessel's owners, and possible catastrophic damage to the vessel if insufficient oil remains for the rear stern bearing. If sea water is allowed in, it may cause a catastrophic damage to the main stern bearing since the sea water will impair the lubricating efficiency of the oil system.

Further, given the size of the ocean going vessel, the captain is frequently unaware that the shaft has been fouled by a fish net until the net has already impaired the seal. The first indication of the problem to the captain is normally the discharge of the oil into the water, or the admixture of the sea water to the bearing oil.

When the shaft seal has been thus fouled by a fish net, the vessel must be stopped, a diver found, the rope guard opened, and the voyage delayed for several hours while the diver clears the netting from the shaft. In some case, where the seal has been damaged, or portions of the netting have been irretrievably wrapped between the shaft and the seal, it is necessary to remove or replace the shaft seal, thereby resulting still further delays, and great expense since the shaft seals on the vessel of this size can easily be several feet in diameter. The cost of keeping a fully loaded vessel idle can easily involve a loss in revenue and penalties of thousands of dollars for each hour that the ship is delayed.

Prior art rope and net guards have been designed primarily for smaller boats and outboard motors, wherein a line or net will actually foul and stall the propeller.

U.S. Pat. Nos. 4,447,215; 4,507,091; and 4,544,363 are illustrative of a line and net guard which uses a stationary blade and a rotating blade to sever lines and nets which might otherwise foul the propeller. While efficient, such devices would be inapplicable to a large going vessel, since scaling them up in a size necessary to make them practical, would result in an undue drag and disturbance of the water passing through the propeller.

U.S. Pat. No. 4,450,670 illustrates a stationary blade intended to be mounted adjacent to the propeller of an outboard motor. The blade is presented with three cutting edges to shear underwater foliage that might otherwise foul the propeller.

U.S. Pat. Nos. 67,982 and 1,649,657 disclose devices for preventing the fouling of a ship or a large vessel propeller. The '982 patent discloses a pair of rotating cutting rings which are mounted on the propeller shaft. The '657 patent discloses a series of serrated cutting edges which are stationary, and cooperate with the ship's propeller to sever any lines which are wrapped about the cutting edges by virtue of the motion of the ship's propeller. In one embodiment of this invention, axially extending teeth are provided on the inner surface of the guard for severing any ropes or lines which may find the way inside the guard. Guards of these designs also create undue drag and turbulence for the vessel's propellers

SUMMARY OF THE INVENTION

It is an object of the present invention to provide a combined rope and fish net guard for use on a marine ocean going vessel which will combine an annular rope guard and a stationary cutting ring to sever any lines or nets which pass through the rope guard.

It is another object of the present invention to provide a combined rope and fish net guard which will sever mono-filament fish netting before it has an opportunity to become wrapped around the propeller shaft of the large ocean going vessel.

It is another object of the present invention to provide a combined rope guard and seal protector, wherein the rope guard comprises an annular ring surrounding and coaxial with the propeller shaft of the vessel. The rope guard is secured to the stern frame of a vessel, and extends outwardly to closely overlap the hub of the propeller to thereby define a streamlined and turbulence free entry zone for the water passing through the propeller blades. A cutting ring is provided on the inside of the annular rope guard, with the cutting ring extending inwardly into a recess formed in the rotating propeller boss, whereby any fish net passing between the rope guard and the propeller boss will be severed by the stationary cutting ring.

It is still a further object of the present invention to provide an improved rope and fish net guard wherein a rotating propeller cooperates with a stationary rope guard, and a stationary cutting ring to enhance the ability of the rope guard to protect the propeller, and the propeller shaft from fouling.

It is still a further object of the present invention to provide a streamlined rope and fish net guard which will present no external serrations or turbulence inducing ridges in the flow passageway immediately preceding the propeller of a large ocean going vessel.

It is still another object of the present invention to provide a combined rope and propeller guard which will provide cutting edges which are effective to sever a line or fish net, regardless of the direction of rotation of the ship's propeller.

DETAILED DESCRIPTION OF THE PREFERRED EMBODIMENTS

Figure 1:
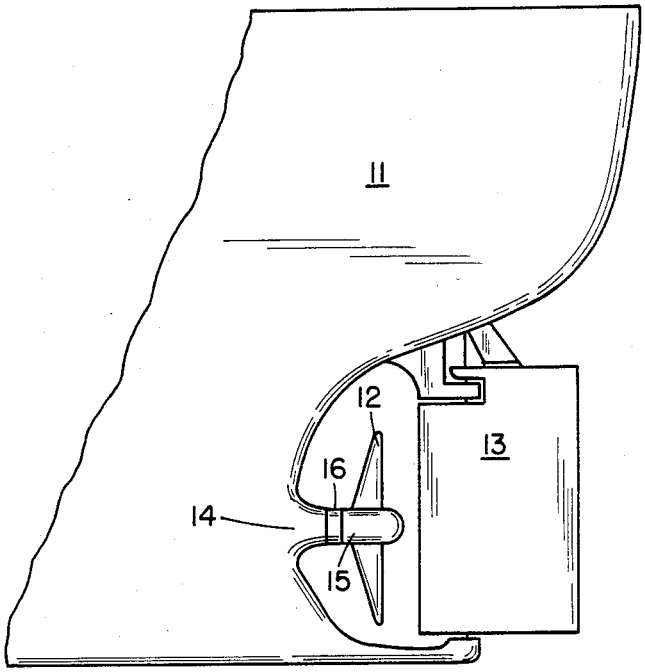
FIG. 1 is a schematic illustration of the stern section of a large ocean going vessel.

As illustrated in FIG. 1, a large ocean going marine vessel 11 is equipped with one or more propellers 12, which are positioned between the vessel 11 and one or more rudders 13. The propeller 12 is mounted on a propeller shaft (illustrated in FIG. 3) which extends from the stern frame 14 of the vessel to engage the propeller hub 15. The combined rope and fish net guard 16 is installed between the stern frame of the vessel and the propeller hub 15. As illustrated in FIG. 1, the configuration of the stern frame 14, the propeller hub 15, and the annular rope guard 16 provides a smooth, turbulence free entry way for the water passing through propeller 12. In a large ocean going vessel, propeller 12 can range from 10 to 30 feet in diameter, with the annular rope guard having a diameter of 1 to 10 feet.

Figure 3:
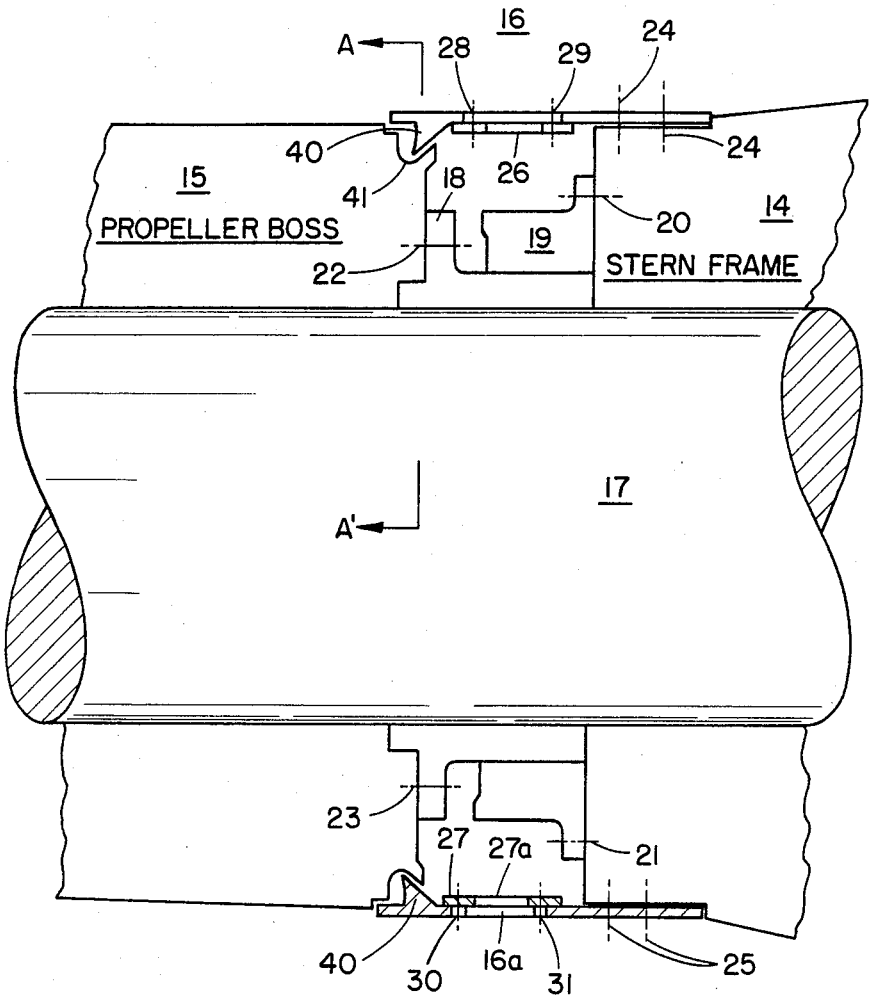
FIG. 3 is a cross-section of the present invention illustrating its relationship to the stern frame of the vessel, the propeller shaft, and the propeller boss.

The present invention is illustrated in cross-section in FIG. 3. In FIG. 3, the propeller shaft 17 extends outwardly from the stern frame of the vessel to engage the propeller hub 15. Between the stern frame and the propeller hub is the shaft seal assembly having a first rotating member 18 and a second stationary member 19. A stationary portion of the shaft seal assembly 19 is secured to the stern frame by bolts spaced about the circumference of the seal and diagramatically illustrated by axes 20 and 21. Likewise, the rotating portion 18 of the shaft seal assembly is secured to the propeller hub by bolts that are spaced circumferentially about shaft 17 and diagramatically illustrated by axes 22,23.

The annular rope guard 23 is stationary, and defines a cylindrical annulus secured to the stern frame by bolts spaced around the circumference of the stern frame, and diagramatically illustrated at axes 24,25. Inasmuch as annular rope guard 16 may be several feet in diameter, it may be desirable to form the rope guard in circumferential sections. Various section members are secured to one another by means of inner re-enforcing plates at each of circumferential junctions, two of which are illustrated in FIG. 3, as 26,27. Plate 26 is secured to the outer sections of the annular rope guard by bolts, which are diagramatically illustrated by axes 28,29. Likewise, plate 27 is secured to the outer circumferential sections of annular rope guard 16 by bolts, two of which are diagramatically illustrated by axes 30,31.

An inspection hole **16*a* may be provided in the annular rope guard 16 which corresponds to opening 27*a* formed in re-enforcing plate 27. This an inspection hole will provide diver access to the shaft seal assembly 18,19. In conventional practice, the plate member 16*a* is secured to the inner re-enforcing plate 27** by means of bolts which are removed at the time that inspection is desired.

The approved rope guard of the present invention, includes an annular cutting ring 40 which extends radially inward from the annular rope guard 16, into a corresponding annular groove 41 formed in a recessed surface of propeller hub.

Figure 2:
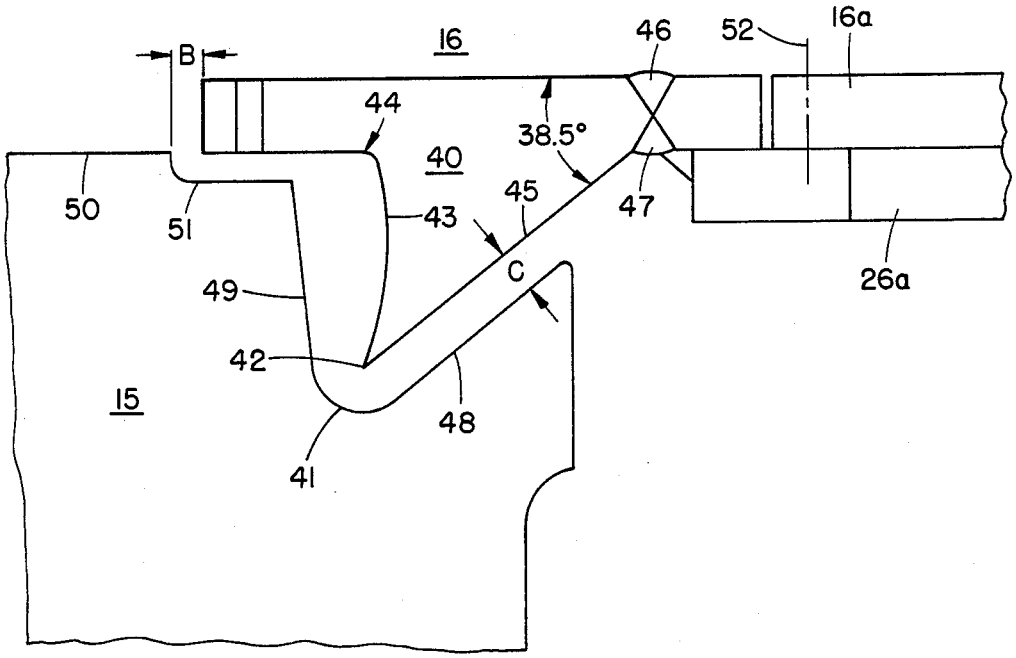
FIG. 2 is cross-section of a portion of the present invention which illustrates the clearances and angles used in forming the device.

The relationship between the cutting ring 40 and the annular groove 41 is more fully illustrated in FIG. 2. As illustrated in FIG. 2, the cutting ring 40 is formed of stainless steel with a hardened and sharpened cutting edge 42. The ring is forged with a triangular cross-section with the cutting edge 42 at the apex of the inwardly protecing triangle. In one embodiment of the invention, the stainless steel cutting ring was formed with a radially inward face 43 having a radius curve between the base portion 44 and the apex 42. The third side 45 of the triangle was formed with a 38½ degree angle with respect to base member 44. The assembly was secured to the annular rope guard 16 by means of a double-butt weld 46,47. In this embodiment, the gap, indicated in FIG. 2 by the letter B, was 6 mm, with the total inwardly projecting dimension of the cutting ring being approximately 45 mm from the inner annular surface 44 of the cutting ring 40.

The goove 41, formed in the propeller hub 15, defines first 48 and second 49 radially inward walls with the first radially inward wall 48 being substantially parallel to surface 45, or approximately 38.5° from surface 50. The surfaces 45 and 48 are maintained approximately 9 mm across as indicated by the letter C in FIG. 2. Propeller hub 15 also defines a radially inward annular groove 51 which cooperates with the rope guard 16 to define a clearance of approximately 6 mm therebetween.

Inspection hole **16*a* is provided in the annular rope guard 16 to provide access to the seal assemblies as indicated previously in FIG. 3. A inspection hole cover 16*a* is bolted to junction plate 26*a* by a circumferential series of bolts one of which is schematically illustrated as axis 52**.

Figure 4:
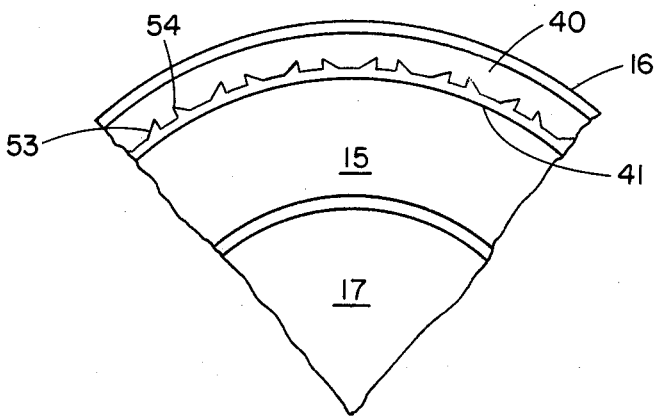
FIG. 4 is a partial cross-section taken along section lines A—A in FIG. 3.

FIG. 4 is a partial cross-section along section line A—A of FIG. 3. As illustrated, propeller hub is mounted on shaft 17 with the lowermost portion of the annular groove 41 illustrated in FIG. 4. The cutting ring 40 is formed with a series of teeth formed therein having opposed cutting surfaces, two of which are diagramatically illustrated at 53,54. While only two teeth have been numbered for the purposes of illustration in FIG. 4, it should be understood that bidirectional cutting teeth are oriented along the entire circumference of cutting ring 40.

In operation, if a mono-filament fish net should become tangled in propeller 12, and wrapped about the stern frame 14, the rope guard 16, or the hub 15, it would sever by virtue of the relationship between the fixed cutting ring 40, and the annular groove 41. If the fish net should be drawn tight across the juncture between the rotating propeller and the stationary rope guard 16, it will be drawn into the passageway defined by the arrow B in FIG. 2. However, due to the serpentine nature of the passageway, it cannot rise up over the radially outward extended face 48 without first contacting the serrated cutting teeth 53,54 formed on cutting edge 42 of cutting ring 40. It is a combination of the rotational movement of the propeller hub 15, the stationary cutting ring 40 and the passageway between the groove and the cutting ring which renders it impossible for long indefinite lengths of the fish net to be drawn into the shaft seal zone.

As thus described, the foregoing objects have been made apparent by the description of the invention as set forth in the figures and specification, and since certain modifications could be made in the construction illustrated in the drawings without departing from the scope of the invention, it is to be understood that the following claims are intended to cover the definition of the invention herein described.

We claim:

1. A combined rope and fish net guard for protecting the shaft and shaft seal of a marine propeller shaft, said guard comprising:

(a) an inwardly extending groove formed in a outer rotating surface of a propeller hub;

(b) a streamlined cylindrical rope guard extending from a stern section of a vessel to said propeller hub, to overlap said inwardly extending groove, (c) a cutting ring mounted on an inner surface of said rope guard, said cuting ring extending inwardly into said inwardly extending groove, so that any lines or nets which pass between said guard and said propeller hub are severed by said cutting ring, whereby the external configuration of the rope guard and propeller boss define a streamlined and turbulance free entry for a marine propeller.

2. A combined rope and net guard as claimed in claim 1, wherein said ring has a serrated inner edge.

3. A combined rope and net guard as claimed in claim 1, wherein said ring has a plurality of radially oriented cutting edges.

4. A combined rope and net guard as claimed in claim 3, wherein alternate cutting edges are oriented in opposite direction of rotation.

5. A combined rope and net guard as claimed in claim 1, wherein said cutting ring has a plurality of bidirectional cutting edges.

6. A shaft seal guard for a marine propeller shaft and seal, said guard comprising:

(a) a streamlined annular rope guard, said guard surrounding and coaxial with a propeller shaft to be protected, said guard having an inner cylindrical surface, (b) a cylindrical hub formed on a marine propeller, said hub defining a first stepped cylindrical surface with said stepped cylindrical surface cooperating with and extending within the inner cylindrical surface of said annular rope guard, said stepped cylindrical surface defining a circumferential groove therein, (c) a cutting ring mounted on the inner cylindrical surface of said annular rope guard, said cutting ring extending inwardly in the circumferential groove defined by the propeller boss, so that any monofilament fish nets drawn into the annular rope guard by the rotation of the propeller will be severed by the cutting ring, whereby the external configuration of the rope guard and propeller boss define a streamlined and turbulence free entry for a marine propeller.

7. A combined rope and net guard as claimed in claim 6, wherein said ring has a serrated inner edge.

8. A combined rope and net guard as claimed in claim 6, wherein said ring has a plurality of radially oriented cutting edges.

9. A combined rope and net guard as claimed in claim 8, wherein alternate cutting edges are oriented in opposite direction of rotation.

10. A combined rope and net guard as claimed in claim 6, wherein said cutting ring has a plurality of bidirectional cutting edges.

* * * * *

UNITED STATES PATENT AND TRADEMARK OFFICE

CERTIFICATE OF CORRECTION

PATENT NO. : 4,722,667

DATED : February 2, 1988

INVENTOR(S) : Arvind Rikhy, et al.

It is certified that error appears in the above-identified patent and that said Letters Patent is hereby corrected as shown below:

On the Title Page, under Inventors: "Makirnos" should read as --Makrinos--

Column 4, line 9: "This an inspection" should read as --This inspection--

Column 4, line 26: "protecing" should read as --protecting--

Column 5, lines 41-42, Claim 1: "turbulance" should read as --turbulence--

Column 6, line 26, Claim 6: "propeller boss" should read as --cylindrical hub--

Column 6, line 31, Claim 6: "propeller boss" should read as --cylindrical hub--

Signed and Sealed this

Twenty-seventh Day of December, 1988

*Attest:*

*Attesting Officer*

DONALD J. QUIGG

*Commissioner of Patents and Trademarks*